US009415493B2

(12) United States Patent
Hohmann et al.

(10) Patent No.: US 9,415,493 B2
(45) Date of Patent: Aug. 16, 2016

(54) TENSION DEVICE FOR STRAINING A THREADED BOLT

(71) Applicants: Jörg Hohmann, Meschede (DE); Frank Hohmann, Warstein (DE)

(72) Inventors: Jörg Hohmann, Meschede (DE); Frank Hohmann, Warstein (DE)

( * ) Notice: Subject to any disclaimer, the term of this patent is extended or adjusted under 35 U.S.C. 154(b) by 234 days.

(21) Appl. No.: 14/051,490

(22) Filed: Oct. 11, 2013

(65) Prior Publication Data

US 2014/0174262 A1 Jun. 26, 2014

(30) Foreign Application Priority Data

Oct. 11, 2012 (DE) ..... 10 2012 109 681

(51) Int. Cl.
*B25B 29/02* (2006.01)

(52) U.S. Cl.
CPC ..... *B25B 29/02* (2013.01)

(58) Field of Classification Search
CPC ..... B23P 19/06; B25B 29/02
USPC ..... 81/57.38, 57.39
See application file for complete search history.

(56) References Cited

U.S. PATENT DOCUMENTS

| | | | | | |
|---|---|---|---|---|---|
| 2,866,370 | A | * | 12/1958 | Biach | B23P 19/067 254/29 A |
| 3,230,799 | A | | 1/1966 | Maciulaitis | |
| 3,679,173 | A | * | 7/1972 | Sherrick | B25B 29/02 254/29 A |
| 3,749,362 | A | | 7/1973 | O'Connor et al. | |
| 3,995,828 | A | * | 12/1976 | Orban | B25B 29/02 254/29 A |
| 4,246,810 | A | * | 1/1981 | Keske | B25B 29/02 81/57.38 |
| 4,438,901 | A | * | 3/1984 | Reneau | B25B 29/02 254/29 A |
| 4,535,656 | A | * | 8/1985 | Orban | B23P 19/06 376/260 |
| 4,998,453 | A | | 3/1991 | Walton et al. | |
| 7,066,699 | B2 | * | 6/2006 | Gosling | B23P 11/022 411/14.5 |
| 2011/0271798 | A1 | | 11/2011 | Wagner et al. | |

FOREIGN PATENT DOCUMENTS

| | | | |
|---|---|---|---|
| DE | 28 55 454 | A1 | 8/1979 |
| DE | 3047674 | A1 | 7/1982 |
| DE | 3237324 | A1 | 4/1984 |
| DE | 40 12 980 | A1 | 10/1991 |
| DE | 43 41 707 | A1 | 6/1995 |
| DE | 102007015975 | A1 | 10/2008 |
| GB | 1 584 158 | B1 | 2/1981 |

* cited by examiner

*Primary Examiner* — Hadi Shakeri
(74) *Attorney, Agent, or Firm* — Gudrun E. Huckett

(57) ABSTRACT

A tension device for straining a threaded bolt by applying a pulling force on a threaded end portion has a housing and a piston moveably disposed therein. A hydraulic supply is connected to the housing. A supporting tube is arranged on the housing. The supporting tube is arranged between the housing and a base surrounding the threaded bolt and transmits tension forces acting in the housing to the base surrounding the threaded bolt. A pull nut to be fastened by threaded engagement on a threaded end portion of the threaded bolt is provided. The pull nut has a pressure face supported in longitudinal direction on a pressure transmission face of the piston. A return spring acting on the piston in a direction toward the supporting tube has a first end bearing against a housing-side spring support and a second end bearing against a piston-side spring support.

11 Claims, 2 Drawing Sheets

TENSION DEVICE FOR STRAINING A THREADED BOLT

BACKGROUND OF THE INVENTION

The invention relates to a tension device for straining a threaded bolt by a pull on its threaded end portion, with a one-part or multi-part housing having at least one piston movable therein in the longitudinal direction and connectable to a hydraulic supply, with a supporting tube which is arranged as a prolongation of the housing and discharges the tension forces acting in the housing to a base surrounding the threaded bolt, and with a pull nut which can be fastened by means of thread engagement on a threaded end portion of the threaded bolt and which is supported in the longitudinal direction, by means of a pressure face, against a pressure-transmission face formed on the piston.

In as bolt tension device, such as is known, for example, from DE 43 41 707 A1, the hydraulic piston and the tension cylinder has to be pressed back into its lower initial position again after the conclusion of the tensioning process and therefore after pressure relief has occurred. This is troublesome, above all in the case of frequent or recurring tensioning processes, and results in loss of time until the tension device is prepared for the next tensioning process.

The object of the invention, therefore, is, by means of measures which can be implemented on the tension device at a low outlay in assembly terms, to arrive at an automatic piston return, so that, after the end of the respective tensioning process, the piston does not first have to be moved back into its initial position again by the application of force.

SUMMARY OF THE INVENTION

To achieve this object, a tension device for straining a threaded bolt having the following features is proposed: at least one return spring is acting upon the piston in the direction towards the supporting tube and bears, with one end, against a housing-side spring support and, with the other end, against a piston-side spring support.

By means of the return springs and its bearing, with one end, against the housing-side spring support, and, with the other end, against a piston-side spring support, an automatic piston return is obtained, so that the piston of the tension cylinder does not always have to be pressed back again by the application of force. This type of piston return can be implemented in or on the tension device at a low outlay in assembly terms. The return spring can be exchanged for another, for example stronger or weaker return spring likewise at low outlay in assembly terms.

The return springs are preferably four in number, in which case the springs should be arranged so as to be distributed symmetrically over the circumference of the tension device. There may, however, also be a smaller number of springs, for example there may be overall two parallel-connected return springs lying opposite one another with respect to the mid-axis of the tension device. The advantage of using overall four parallel-connected springs is that an especially tilt-free piston return is thus achieved.

In one refinement, it is proposed that the return spring be arranged level with the piston and, in particular, at a level below thread engagement between the pull nut and the threaded end portion.

According to a further refinement, the two spring supports are oriented such that the housing-side spring support faces the supporting tube and the piston-side spring support faces away from the supporting tube.

According to a further refinement, the return spring, consisting, for example, of layered cup springs or of a helix, surrounds a spar, of which the upper spar end facing away from the supporting tube is secured with respect to the piston, whereas the spar has, at its lower end facing the supporting tube, a widened section, against which the return spring bears.

Furthermore, it is proposed that, to secure the upper spar end, the latter is suspended in an orifice in a flange-like widened section of the piston, the upper spar end being supported on the flange-like widened section preferably from above.

Furthermore, it is proposed that the spar be led longitudinally movably through an orifice, oriented parallel to the piston, in the housing, that region of the housing which surrounds the orifice forming the housing-side spring support.

Furthermore, it is proposed that, as seen in the longitudinal direction, both the flange-like widened section of the piston and the housing have rectangular cross sections level with the orifice, and that in each case a return spring be arranged in the region of each of the four corners of the rectangular cross section.

BRIEF DESCRIPTION OF THE DRAWINGS

Further details and advantages may be gathered from the following description of an exemplary embodiment illustrated in the drawing.

DESCRIPTION OF PREFERRED EMBODIMENTS

Figure 1:
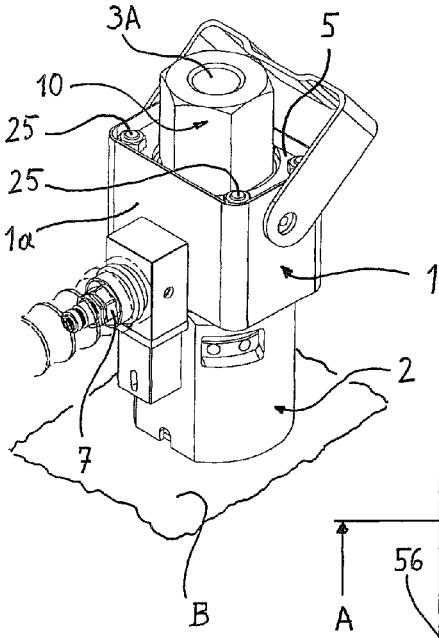
FIG. 1 shows a perspective illustration of a hydraulically operating threaded-bolt tension device which is placed onto a threaded bolt secured by a nut and is supported on the base.
Figure 2:
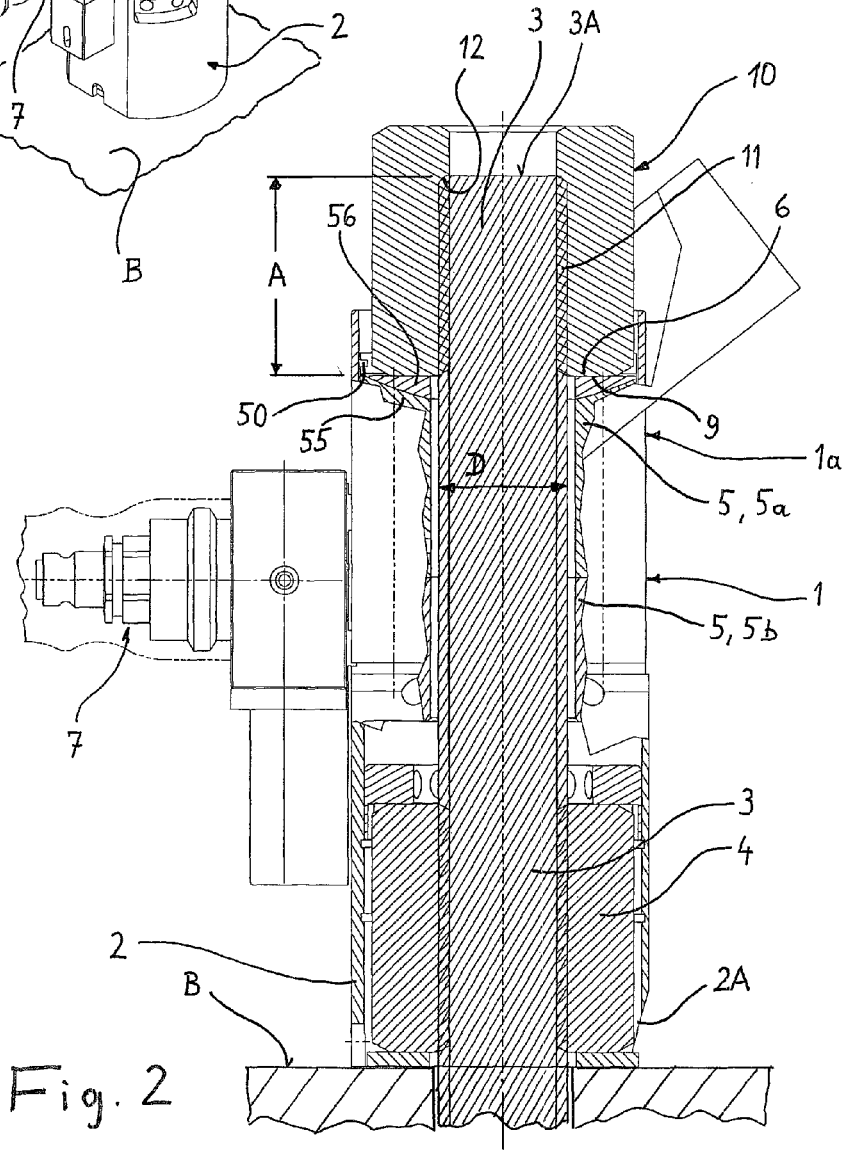
FIG. 2 shows a side view of the threaded-bolt tension device, larger regions being reproduced sectionally along the mid-axis.

The hydraulically driven tension device serves for tightening and, if appropriate, also releasing highly loaded screw connections. The tension device has the task of applying a stipulated pretensioning force to the threaded bolt 3 of a screw connection for a certain time in the bolt longitudinal direction, in order to afford the possibility of tightening or retightening, free of torque, or else releasing the nut 4 screwed onto the threaded bolt 3 and securing the latter.

The tension device described here is designed especially for tensioning or straining those bolt connections in which the thread, projecting beyond the nut 4, of the bolt 3 has a considerable length, and in which this threaded portion has, in particular, a length which amounts to four to eight times the thread diameter D.

As an element temporarily exerting a pull on the bolt, a pull nut 10 of the bolt tension device is screwed onto the end portion A of the threaded portion projecting beyond the nut 4. The pull nut 10 is subsequently subjected hydraulically to a pulling force, with the result that the threaded bolt 3 is strained in the longitudinal direction.

The bolt tension device has a rigid housing 1. In the exemplary embodiment, it consists of two housing parts 1*a*, 1*b*. The housing 1 is continued rigidly downwards in the longitudinal direction in a supporting tube 2 which is open on its underside and which is supported on that base B, mostly a machine part, on which the nut 4 is also supported. The supporting tube 2 and a tension device therefore diverts the tension reaction forces acting on the housing 1 to the fixed base B. The supporting tube 2 surrounds the nut 4 and leaves room for the latter, without obstructing the turning of the nut 4 arranged inside the supporting tube 2.

Located laterally on the housing 1 is a hydraulic connection 7, via which piston spaces arranged in the tension device can be connected to a switchable high-pressure hydraulic supply.

Moreover, a gear may be provided, which operates through an orifice 2A in the supporting tube 2 and with the aid of which the nut 4 seated on the threaded bolt 3 can be turned. This turning is possible only when the tension device is operating and therefore the nut 4 is not loaded by considerable friction, particularly with respect to the base B.

The housing 1 comprises at least one hydraulic cylinder which is connected to the external hydraulic supply via the hydraulic connection 7 and a flexible pressure-resistant hydraulic line.

Figure 4:
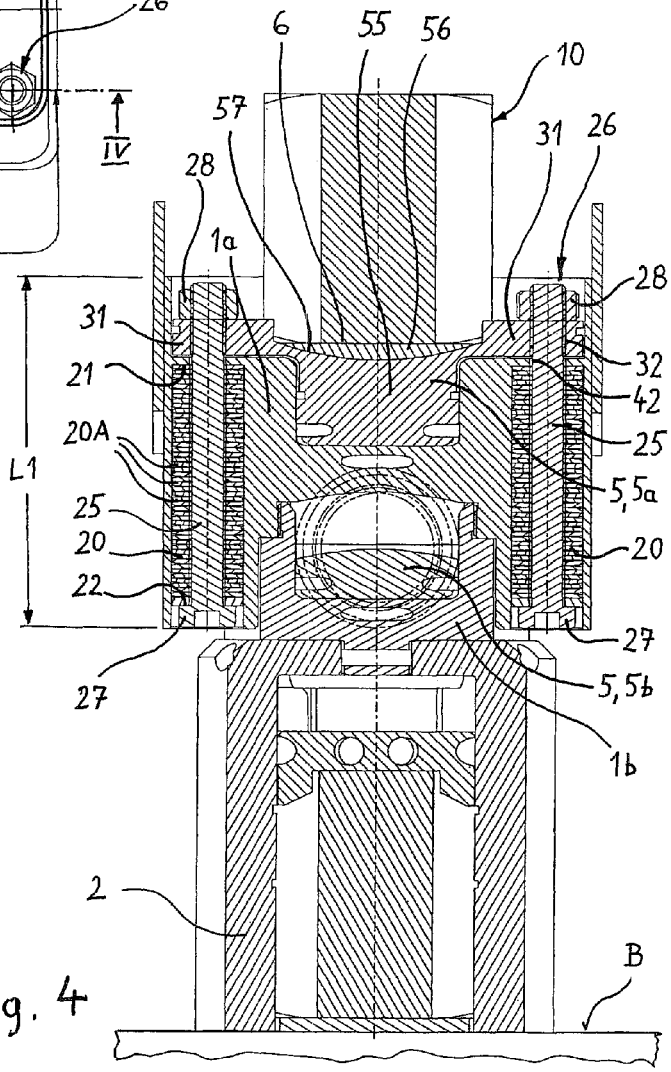
FIG. 4 shows a section through the threaded-bolt tension device corresponding to the sectional plane IV-IV marked in FIG. 3 and arranged so as to be offset to the mid-axis.

In the exemplary embodiment described here, two hydraulic cylinders are connected in series. For this purpose, as can be seen in FIG. 4, the housing 1 is composed of two pressure-resistant housing parts 1*a*, 1*b* which in each case surround a piston space and consequently a hydraulic working space. A piston 5*a*, 5*b* is arranged movably in the longitudinal direction in each piston space, at the same time being sealed off with respect to the inner wall of the respective housing part 1*a*, 1*b*. The pistons 5*a*, 5*b* bear one against the other in the longitudinal direction and are thus arranged in a series connection.

When the hydraulic supply is switched on, by hydraulic pressure being fed into the piston spaces, the pistons 5*a*, 5*b* arranged therein are jointly raised. This takes place counter to the action of spring elements described in more detail below.

The piston 5 or, in the case of a multi-part piston, its uppermost piston 5*a* bears in the longitudinal direction with a pressure transmission face 6 against the underside, serving as a pressure face 9, of the pull nut 10. Raising the piston 5 therefore results in an identical movement and take-up of the pull nut 10 and consequently in a torsion-free stretching of the threaded bolt.

The pull nut 10 which can be screwed together with the end portion A of the external thread of the threaded bolt 3 is configured so as to be exchangeable, that is to say it can, if required, be exchanged for a pull nut 10 of another size or geometry, whereas the one-part or multi-part piston 5 does not have to be exchanged for another piston.

For tensioning the threaded bolt 3, first the pull nut 10 is screwed with its internal thread 11 onto the threaded end portion A of the threaded bolt. The internal thread 11 preferably does not extend over the entire length of the pull nut 10. Instead, the pull nut 10 has, following the internal thread 11, a longitudinal stop 12 which bears axially against the end face 3A of the threaded bolt only when the pull nut 10 is screwed on completely and therefore correctly. The longitudinal stop 12 is located on a threadless longitudinal portion of the pull nut 10, the longitudinal portion projecting radially inwards with respect to the thread 11.

By hydraulic pressure subsequently being fed in, the piston 5 guided in the cylinder of the housing 1 and supported from below against the pull nut 10 is raised, at the same time taking up the pull nut 10, thus resulting in the longitudinal straining of the threaded bolt 3. This entails a loss of friction on the underside of the nut 4, so that the latter can then be turned, for example retightened, on the thread of the bolt.

So as not to have to press the piston 5 back into its initial position again by the application of force after the conclusion of each individual tensioning process, above all in the case of frequent tensioning processes, return springs 20 acting upon the piston 5 in the direction towards the supporting tube 2 are provided. In the exemplary embodiment, there are overall four such springs 20 connected in parallel, although a smaller or larger number of springs 20 may also be suitable.

According to FIG. 4, the individual return spring 20 is supported, with one end, against a housing-side spring support 21, that is to say a bearing face designed to be rigid with respect to the housing 1 or 1*a*, and, with the other end, against a piston-side spring support 22, that is to say a bearing face designed to be rigid with respect to the piston 5.

FIG. 4 reveals, in conjunction with FIG. 3, the configuration both of the housing 1 and of the two-part piston 5 guided longitudinally therein, and also the especially assembly-friendly accommodation of the return springs 20, the return springs 20 being arranged in a space-saving way below the thread engagement between the pull nut 10 and a threaded end portion A.

For this purpose, indeed, the piston 5 is cylindrical or of circular cross section where it is guided, sealed off, in the housing 1 and thus delimits the working space of the hydraulic cylinder. However, the piston 5 has a longitudinal portion, on which, as seen in the longitudinal direction, it is provided with radial widened sections 31 in the manner of flanges. The widened sections 31 make available the space for accommodating the return springs 20.

Figure 3:
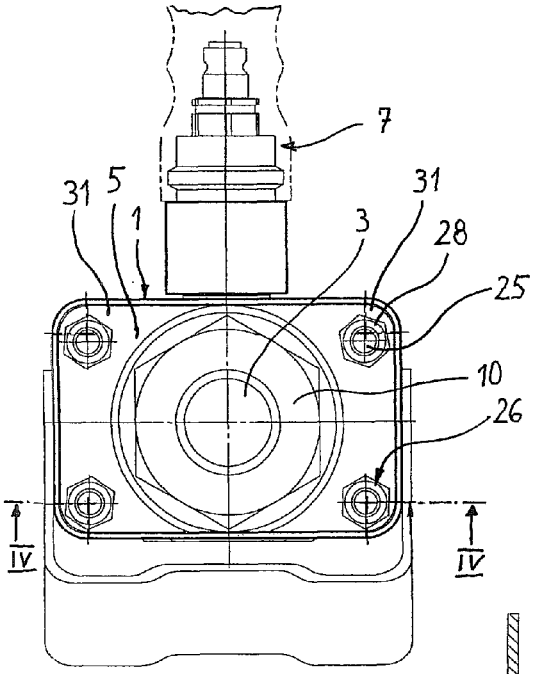
FIG. 3 shows a top view of the threaded-bolt tension device.

In the exemplary embodiment, this longitudinal portion of the piston is provided with overall four widened sections 31 enlarged radially with respect to the remaining cylindrical piston shape, with the result that the longitudinal portion has a rectangular cross section which can be seen clearly in FIG. 3. The four widened sections 31, configured as flanges, form the corner regions of the rectangle. One of the four return springs 20 is arranged in each of the corner regions.

Each of the flange-like widened sections 31 of the piston 5 is provided with an orifice 32 which extends parallel to the longitudinal axis of the piston.

Correspondingly to the configuration of the piston, the housing 1, too, has a rectangular cross section over part of its length. The housing 1 has this rectangular cross section essentially on that housing longitudinal portion L1 on which the one-part or two-part piston 5 is located in the housing interior.

In alignment with the orifices 32 in the flange-like widened sections 31 of the piston 5, the housing 1 is also provided in each case with an orifice 42. The orifice 42 is followed downwards, that is to say towards the supporting tube 2, by a preferably cylindrical spring chamber which affords sufficient space for receiving the respectively turned spring 20.

A rigid spar 25 extends longitudinally through the spring chamber. It is secured with its upper spar end 26 to the piston 5 or to the upper piston 5*a*, whereas the lower spar end is configured as a widened section 27, comparable to the shape of a screw head. The top side of the widened section 27 is the piston-side spring support 22.

That region of the housing 1 which surrounds the orifice 42, that is to say the wall upwardly delimiting the spring chamber, serves as the housing-side spring support 21.

To connect the spar 25 to the piston 5, a nut 28 is screwed onto a thread at the upper spar end 26, the diameter of the nut being larger than the diameter of the orifice 32 arranged beneath it. By means of the nut 28, therefore, the spar 25 can be supported from above on the flange-like widened section 31 of the piston 5.

The spring chamber is open downwards. To assemble or to exchange the return spring 20, therefore, first the nut 28 is released at the upper spar end 26. The return spring 20 can then be removed, together with the spar 25, from the housing 1 downwards. Assembly takes place in reverse order.

In the exemplary embodiment reproduced here, each return spring 20 consists of a plurality of cup springs 20A layered one upon the other. Instead of the cup springs 20A, a helical spring rated for the corresponding pressure can also be used.

The piston 5 is provided with a marking 50 to identify its maximum permissible piston stroke.

In order to balance any slight tilting between the pull nut 10 and threaded end portion A, the piston 5 or, here, the upper piston 5A is configured so as to be divided in two. It is composed of a base body 55, which, facing away from the supporting tube 2, is configured as a bowl or spherical cap, and of a correspondingly configured ring 56 which is formed spherically on its underside and is thus located between the piston 5 and the pull nut 10. Along the common spherical line 57 forming a ball socket, the ring 56 can assume a certain angular pitch relative to the base body 55 of the piston, in order thereby to balance inaccuracies of the thread on the threaded bolt 3.

The specification incorporates by reference the entire disclosure of German priority document 10 2012 109 681.3 having a filing date of Oct. 11, 2012.

While specific embodiments of the invention have been shown and described in detail to illustrate the inventive principles, it will be understood that the invention may be embodied otherwise without departing from such principles.

LIST OF REFERENCE CHARACTERS

1 Housing
1*a* Housing part
1*b* Housing part
2 Supporting tube
2A orifice
3 Threaded bolt
3A end face of threaded bolt
4 Nut
5 Piston
5*a* Piston
5*b* Piston
6 Pressure transmission face
7 Hydraulic connection
9 Pressure face
10 Pull nut
11 Internal thread
12 Longitudinal stop
20 Return spring
20A Cup spring
21 Spring support, housing side
22 Spring support, piston side
25 Spar
26 Upper spar end
27 Widened section, lower end of the spar
28 Nut
31 Flange-shaped widened section
32 Orifice
42 Orifice
50 Marking
55 Base body
56 Ring
57 Spherical line
A Threaded end portion
B Base
D Thread diameter
L1 Part-length

What is claimed is:

1. A tension device for straining a threaded bolt by applying a pulling force on a threaded end portion of the threaded bolt, the tension device comprising:

a one-part or multi-part housing;

at least one piston disposed in the housing and movable in a longitudinal direction of the housing, the at least one piston comprising a pressure transmission face;

a hydraulic supply connected to the housing;

a supporting tube arranged on the housing as a prolongation of the housing, wherein the supporting tube is arranged between the housing and a base surrounding the threaded bolt and transmits the tension forces acting in the housing to the base surrounding the threaded bolt;

a pull nut comprising an internal thread, the internal thread configured to be screwed directly onto a threaded end portion of the threaded bolt, wherein the pull nut has a downwardly facing end face forming a pressure face that is supported in the longitudinal direction of the housing directly on the pressure transmission face of the at least one piston;

at least one return spring acting on the at least one piston in a direction toward the supporting tube, wherein the at least return spring has a first end bearing against a housing-side spring support and has a second end bearing against a piston-side spring support;

wherein the at least one return spring is arranged below the pull nut and below a section of the threaded end portion that is directly engaged by the pull nut when the pull nut is screwed onto the threaded end portion of the threaded bolt.

2. The tension device according to claim 1, wherein the at least one return spring is arranged level with the at least one piston.

3. The tension device according to claim 1, wherein a total of four of the at least one return spring are provided, wherein the four return springs are parallel to each other and distributed around the at least one piston.

4. The tension device according to claim 1, wherein the housing-side spring support faces the supporting tube and the piston-side spring support faces away from the supporting tube.

5. The tension device according to claim 1, further comprising at least one spar, wherein the at least one return spring surrounds the at least one spar, wherein the at least one spar has an upper spar end facing away from the supporting tube and being secured relative to the piston, and wherein the at least one spar has a lower end facing the supporting tube and having a widened section, wherein the at least one return spring bears against the widened section.

6. The tension device according to claim 5, wherein the upper spar end is seated in an orifice of a flange-shaped widened section of the at least one piston, wherein the upper spar end is supported on the flange-shaped widened section.

7. The tension device according to claim 6, wherein the upper spar end is supported on an upwardly facing side of the flange-shaped widened section.

8. The tension device according to claim 6, wherein a total of four of the at least one return spring are provided, wherein, viewed in the longitudinal direction of the housing, the flange-shaped widened section of the at least one piston and the housing each have a rectangular cross section at a level of the orifice, wherein in each corner of the rectangular cross-section one of the four return springs is arranged.

9. The tension device according to claim 5, wherein the housing has an orifice having a center axis that is oriented parallel to the at least one piston, wherein the at least one spar extends through the orifice in the housing and is moveable in the longitudinal direction of the housing, wherein a region of the housing surrounding the orifice of the housing forms the housing-side spring support.

10. The tension device according to claim 1, wherein the at least one piston comprises a ring and a base body, wherein the ring is arranged between the base body and the pull nut, wherein the faces of the base body and the ring, the faces being in mutual contact, are spherical.

11. The tension device according to claim 1, wherein the pull nut comprises an internally threaded portion comprising the internal thread and a longitudinal portion projecting radially relative to the internally threaded portion, wherein a longitudinal stop adapted to be supported against an end face of the threaded bolt is formed on the longitudinal portion.

* * * * *